US010400302B2

(12) United States Patent
Frobose et al.

(10) Patent No.: US 10,400,302 B2
(45) Date of Patent: Sep. 3, 2019

(54) ANNEALING FURNACE AND METHOD FOR ANNEALING A STEEL STRAND

(71) Applicant: SANDVIK MATERIALS TECHNOLOGY DEUTSCHLAND GMBH, Dusseldorf (DE)

(72) Inventors: Thomas Frobose, Versmold (DE); Christofer Hedvall, Bielefeld (DE)

(73) Assignee: Sandvik Materials Technology Deutschland GmbH, Düsseldorf (DE)

( * ) Notice: Subject to any disclaimer, the term of this patent is extended or adjusted under 35 U.S.C. 154(b) by 409 days.

(21) Appl. No.: 15/105,782

(22) PCT Filed: Dec. 10, 2014

(86) PCT No.: PCT/EP2014/077183

§ 371 (c)(1),
(2) Date: Jun. 17, 2016

(87) PCT Pub. No.: WO2015/091138

PCT Pub. Date: Jun. 25, 2015

(65) Prior Publication Data

US 2016/0326609 A1 Nov. 10, 2016

(30) Foreign Application Priority Data

Dec. 19, 2013 (DE) ..... 10 2013 114 578

(51) Int. Cl.
*C21D 9/52* (2006.01)
*C21D 8/06* (2006.01)
(Continued)

(52) U.S. Cl.
CPC ..... *C21D 9/525* (2013.01); *B21C 9/00* (2013.01); *C21D 1/613* (2013.01); *C21D 8/065* (2013.01);
(Continued)

(58) Field of Classification Search
CPC ..... B21C 9/00; C21D 1/613; C21D 8/065; C21D 9/0056; C21D 9/0062; C21D 9/085;
(Continued)

(56) References Cited

U.S. PATENT DOCUMENTS 2,602,653 A * 7/1952 Cope ..... C21D 9/561 266/102
4,704,167 A * 11/1987 Ichida ..... C21D 9/573 148/661
(Continued)

FOREIGN PATENT DOCUMENTS

CN 1215435 A 4/1999
CN 2758275 Y 2/2006
(Continued)

OTHER PUBLICATIONS

LV, Maokun. "High Efficiency Strip Bright Annealing Furnace" Shanghai Metals, (Nonferrous Fascicule) vol. 9, No. 6. Dec. 31, 1988.

*Primary Examiner* — Jessee R Roe
*Assistant Examiner* — Michael Aboagye
(74) *Attorney, Agent, or Firm* — Morgan, Lewis & Bockius LLP

(57) ABSTRACT

An annealing furnace for annealing a strand of steel. The annealing furnace including a first heating apparatus for heating the strand during operation of the annealing furnace. A transport device advances the strand in a direction of transport through the annealing furnace during operation of the annealing furnace. The annealing furnace also includes a first cooling device for cooling the outer surface of the strand with a gas guide in the direction of transport behind the first heater, wherein the gas guide is arranged in such a manner that a gas flows along the outer surface of the strand
(Continued)

during operation of the annealing furnace for cooling the strand.

21 Claims, 4 Drawing Sheets

(51) Int. Cl.

| | |
|---|---|
| ***F27B 9/20*** | (2006.01) |
| ***B21C 9/00*** | (2006.01) |
| ***F27B 9/12*** | (2006.01) |
| ***C21D 9/00*** | (2006.01) |
| ***C21D 1/613*** | (2006.01) |
| ***C21D 9/08*** | (2006.01) |
| ***C21D 9/573*** | (2006.01) |
| *F27D 9/00* | (2006.01) |

(52) U.S. Cl.
CPC ..... *C21D 9/0056* (2013.01); *C21D 9/0062* (2013.01); *C21D 9/085* (2013.01); *C21D 9/573* (2013.01); *F27B 9/12* (2013.01); *F27B 9/20* (2013.01); *F27B 2009/126* (2013.01); *F27D 2009/0008* (2013.01); *F27D 2009/0072* (2013.01)

(58) Field of Classification Search
CPC ... C21D 9/525; C21D 9/573; F27B 2009/126; F27B 9/12; F27B 9/20; F27B 2009/008; F27B 2009/0072
USPC ..... 266/249, 251, 252, 259
See application file for complete search history.

(56) References Cited

U.S. PATENT DOCUMENTS

| | | | | |
|---|---|---|---|---|
| 4,707,167 | A | 11/1987 | Ichida et al. | |
| 6,608,290 | B1 * | 8/2003 | Robinson ..... | C21D 9/561 219/645 |

FOREIGN PATENT DOCUMENTS

| | | | |
|---|---|---|---|
| CN | 102071292 | A | 5/2011 |
| CN | 102373327 | A | 3/2012 |
| CN | 202808871 | U | 3/2013 |
| DE | 3717537 | A1 | 12/1987 |
| DE | 19860472 | A1 | 7/2000 |
| DE | 69623210 | T2 | 4/2003 |
| DE | 60004233 | T2 | 4/2004 |
| DE | 102009045640 | A1 | 4/2011 |
| DE | 102009052779 | A1 | 5/2011 |
| DE | 102012008804 | A1 | 11/2013 |
| EP | 0128734 | A2 | 12/1984 |
| EP | 0803583 | A2 | 10/1997 |
| GB | 1428030 | A | 3/1976 |
| GB | 2128207 | A | 4/1984 |
| JP | S50148309 | U | 12/1975 |
| JP | S56150459 | A | 11/1981 |
| JP | S5970727 | A | 4/1984 |
| JP | H04183820 | A | 6/1992 |
| JP | H06306486 | A | 11/1994 |
| JP | H07241605 | A | 9/1995 |
| JP | H111236622 | A | 8/1999 |
| JP | 2004217974 | | 8/2004 |

* cited by examiner

ANNEALING FURNACE AND METHOD FOR ANNEALING A STEEL STRAND

RELATED APPLICATION DATA

This application is a § 371 National Stage Application of PCT International Application No. PCT/EP2014/077183 filed Dec. 10, 2014, claiming priority of DE Application No. 102013114578.7, filed Dec. 19, 2013.

TECHNICAL FIELD AND INDUSTRIAL APPLICABILITY

The present invention relates to an annealing furnace used for annealing a strand made of steel using a first heating apparatus for heating the strand in the annealing furnace and a transport device for the strand, which is adapted in such a manner that it advaces the strand through the annealing furnace in a direction of transport during operation of the furnace.

The present invention also relates to a method used for annealing a strand made of steel in an annealing furnace following the steps of heating the strand in a first heating apparatus and transporting the strand in the direction of transport through the annealing furnace using a transport device for the strand.

BACKGROUND

Many workpieces must be tempered, for example by cold or hot forming, after their actual production so that they achieve the desired material properties or so that those material properties which have been lost due to deformation are restored.

In particular, stainless steel tubes are annealed after cold pilger rolling or cold drawing in order to increase the ductility of the material.

To ensure maximum production capacity, tempering the workpieces is preferably carried out in a belt furnace, wherein the workpiece is actively advanced through the furnace during the tempering.

SUMMARY

Compared with such known annealing furnaces, the present invention is directed to the problem of providing an annealing furnace which allows the material properties of the finished workpiece to be adapted more accurately and improved if necessary.

This problem is solved by means of an annealing furnace for a steel strand comprising a first heating apparatus for heating the strand in the annealing furnace, a transport device for the strand, which is adapted in such a manner that it transports the strand in a direction of transport through the annealing furnace and behind the first heating device further comprising a first cooling device for cooling the outer surface of the strand having a gas guide, wherein the gas guide is arranged in such a manner that during the operation of the annealing furnace a gas can be guided along the outer surface of the strand for cooling the strand.

It has been found that not only the temperature at which the strand is annealed, and the time over which it is annealed are important for the material properties which a strand of steel obtains after the annealing process, but also the course of cooling after annealing. Therefore, the annealing furnace of the present invention provides the option to purposefully cool the strand after heating in the heating apparatus of the annealing furnace.

Within the scope of the present application a strand of steel is for example an extended oblong profile, a rod or a tube.

A strand of steel, preferably made of stainless steel, is in particular a tube, which is reduced by cold pilger rolls or cold drawing from a tube blank, i.e. deformed. Therefore, an embodiment of the invention is conceivable in which the annealing furnace is a part of an integrated production line with a cold pilger roll mill and an annealing furnace arranged downstream. Alternatively, integration in a production line with a draw bench is possible.

The central element of the annealing furnace is the first heating apparatus, which facilitates heating of the strand to the required annealing temperature. It is thus advantageous if the heating apparatus is arranged in an embodiment of the invention in such a way that the strand is heated to a temperature in the range of from 300° C. to 500° C., preferably from 350° C. to 450° C. and particularly preferably of 400° C.

Although a plurality of embodiments can be seen in such a heating apparatus, an embodiment is advantageous, in which the first heating apparatus comprises an induction coil for inductive heating of the strand. With such an inductive heating apparatus, the strand material can very quickly be heated in a concentrated way within a short range of length.

In an embodiment of the invention the induction coil is arranged and designed in such a manner that the strand passes through the induction coil in the annealing furnace. Here, the strand and the induction coil must preferably be arranged concentrically, particularly when the strand is a cylindrical element such as a rod or a tube with a circular cross section.

In an embodiment of the invention the first heating apparatus comprises a hollow glass cylinder which extends between the strand and the induction coil during the operation of the annealing furnace and preferably surrounds the strand concentrically.

Within the scope of the present invention, a transport device is basically any suitable mechanical device which is able to advance the strand to be annealed through the annealing furnace.

In an embodiment the transport device comprises at least one pair of motor-driven drive rollers which are arranged in such a manner that the drive rollers are engaged with the strand during the operation of the annealing furnace and the strand extends between the drive rollers. In one embodiment the annealing furnace comprises two pairs of motor-driven drive rollers, wherein the first pair is located in the direction of transport in front of the first heating apparatus and the second pair behind the first heating apparatus.

The first cooling device according to the invention has the advantage, based on that a gas current guided past the outer surface of the strand, that the strand is efficiently and rapidly cooled.

In an embodiment of the invention the gas guide comprises a housing surrounding the strand during the operation of the annealing furnace which is preferably arranged concentrically to the strand, wherein the housing comprises a gas inlet and a gas outlet for the gas.

In order to prevent leakage of the gas, the housing comprises one seal at the front end and one seal at the rear end for sealing the tube against the strand during the operation of the annealing furnace.

In an embodiment of the invention the gas inlet of the gas guide is in fluid communication with a reservoir for the gas, wherein this reservoir in operation of the annealing furnace preferably contains hydrogen, so that the outer surface of the strand can be cooled with the gas, in particular hydrogen.

A hydrogen cooling simultaneously allows for a chemical reduction of the steel on the outer surface of the strand.

In an embodiment of the invention the gas outlet in the transport device for the strand is arranged in front of the gas inlet in such a manner that the gas flows against the direction of transport past the strand during the operation of the annealing furnace. This increases the efficiency of the gas cooling.

In another embodiment of the annealing furnace there is a second cooling device for cooling the outer surface of the strand, wherein the second cooling device comprises a contact element which can be brought in engagement with the strand during the operation of the annealing furnace, so that a thermal contact is established between the strand and the contact element. In this way, heat can be efficiently drawn off the strand by thermal conduction.

For this, it is advantageous if the second cooling device used for cooling the outer surface of the strand comprises a pneumatic or hydraulic device, which is designed and arranged in such a manner that it remains engaged with the strand during the operation of the annealing furnace.

It is particularly advantageous if the second cooling device comprises a plurality of contact elements, for example, four contact elements, which are pressed against the strand in opposite directions during the operation of the annealing furnace.

In one embodiment of the invention the contact element comprises graphite. Graphite has the advantage of high thermal conductivity and good friction properties at the same time.

In order to enable efficient heat dissipation from the strand via the contact element, the second cooling device comprises a fluid cooling device in one of the embodiments. This cooling system is arranged in such a manner that it dissipates the heat transferred from the strand to the graphite element during the operation of the annealing furnace.

In an embodiment of the invention the contact element of the second cooling device used for cooling the outer surface of the strand is arranged in the first cooling device to cool the outer surface of the strand. It is advantageous if the contact element is arranged within the housing of the gas guide of the first cooling device for cooling the outer surface of the strand.

The combination of first and second cooling devices for cooling the outer surface of the strand makes possible an efficient and thus rapid cooling in terms of a quenching of the previously red-hot tube. Such a quenching cooling is also referred to as a sudden cooling.

In another embodiment, the annealing furnace comprises a third cooling device used for cooling the outer surface of the strand comprising a housing having a fluid cooling. The third cooling device is preferably arranged in the direction of transport behind the first cooling device, and surrounds the strand during the operation of the annealing furnace. In such a cooling device, the strand is cooled further after the sudden cooling in the first or in the first and second cooling devices, where the cooling effect is based on the fact that the housing of the third cooling device, due to the fluid cooling, has a lower temperature than the strand, which extends inside the housing.

According to one embodiment of the invention, the third cooling device for cooling the outer surface of the strand may additionally or alternatively be provided along with the second cooling device for cooling the outer surface of the strand.

Another embodiment of the annealing furnace comprises a fourth cooling device for cooling the outer surface of the strand, which is arranged so that the strand is sprayed with a fluid, preferably water, during the operation of the annealing furnace.

Here, the fourth cooling device can be either be provided in addition to the second and/or third cooling device or alternatively to them.

In another embodiment of the invention, the annealing furnace comprises a second heating apparatus in the direction of transport of the strand downstream from the first heating apparatus. If the first heating apparatus is for instance, an inductive heating apparatus, then it proves to be advantageous if the second heating apparatus is a conventional heating apparatus with an electrically operated heating wire.

Although the embodiments described so far provide for cooling and flushing of the strand on its outer surface, there is one embodiment of the invention of the annealing furnace that comprises an annealing furnace for annealing a hollow strand with a flushing device for flushing the inner surface of the hollow rod. In this case, this flushing device comprises a gas outlet for flushing the inner surface which outlet can be connected to one end of the hollow strand so that gas used for flushing the inner surface of the hollow strand can be introduced from the gas outlet into the hollow strand during the operation of the annealing furnace, and can flow along the inner surface.

Here, an embodiment is advantageous, in which the gas outlet has a fluid communication with at least one storage container for a gas, preferably argon or a mixture of argon and hydrogen, wherein the gas is supplied from the reservoir during the operation of the annealing furnace.

In one embodiment of the invention, the annealing furnace of the present invention is a part of a forming system for deforming again an already cold-deformed strand comprising a cold-deforming device, that is arranged in the direction of transport of the strand downstream from the annealing furnace.

During the production of strands, in particular of tubes made of stainless steel, it can be advantageous to carry out the deformation of the tube blank to a finished strand sequentially or step-by-step in order to achieve the desired material properties of the finished strand. For this purpose, as a first step a tube blank is reduced by cold deformation, particularly by cold pilger rolling or cold drawing. The resulting strand has a significantly increased tensile strength as compared to the tube blank, which makes it impossible to cold-deform the strand again. Therefore, in one of the embodiments of the present invention, the already cold-deformed strand is annealed in the annealing furnace according to an embodiment of the present invention, and then deformed again in a cold deforming device.

According to an embodiment of the deforming system of the invention, the cold deforming device is particularly a cold-drawing mill or draw bench or a cold pilger rolling mill as they are known from the prior art.

Thus, in one of the embodiments of the invention it is alternatively possible that an already cold deformed strand runs directly from a cold pilger roll system or a cold drawing system into the deforming system of the invention (in-line manufacture) or the already-deformed strand is made available coiled up or in cut-to-length pieces by the deforming system in accordance with the invention.

In another embodiment, a winding device and/or saw that is movable in the direction of transport of the strand is provided behind the cold deforming device of the forming plant according to the invention.

Such a saw that is also moved, also known as flying saw, makes it possible for the strand running out of the cold deforming device to be divided into sections of a desired length while the deforming process is still running. Alternatively, the strand may be wound or coiled up with a winding device. A suitable winding device is described for example in patent application DE 10 2009 045 640 A1.

A cleaning device for cleaning the outer surface of the strand may optionally be provided between the cold deforming plant and the saw and/or the winding device. This cleaning device is used to remove lubricant residues remaining on the outer surface of the strand from the deforming process. Preferably, the cleaning device is a cleaning device which cleans the outer surface of the strand using $CO_2$.

The previously cited problem is also solved by a method for annealing a strand of steel in an annealing furnace, which method comprises the following steps: Heating the strand in a first heating device, transporting the strand in a direction of transport by a transport device through the annealing furnace, cooling the outer surface of the strand in the direction of transport behind the first heater in a first cooling device using a gas guide, wherein a gas flows with the aid of the gas guide along the outer surface of the strand in order to cool the strand.

This process of annealing a strand is particularly used in an embodiment of the invention for manufacturing a strand of steel, wherein a steel blank, preferably steel tube blank, prior to heating of the strand is deformed cold, preferably by cold pilger rolling or cold drawing, into a strand.

As far as aspects of the present invention have been described in terms of the annealing furnace according to the invention, they also apply to the corresponding method used for annealing the strand and vice versa. In so far as the inventive method is carried out using an annealing furnace according to one of the embodiments of this invention, the latter has the appropriate equipment for this purpose. In particular, however, even embodiments of the annealing furnace used for carrying out the embodiments of the method described here are appropriate and the method comprises the steps required for this purpose.

Further advantages, features and possibilities of applications for the present invention will be apparent from the following description of an embodiment and the accompanying figures.

DETAILED DESCRIPTION

Figure 1:
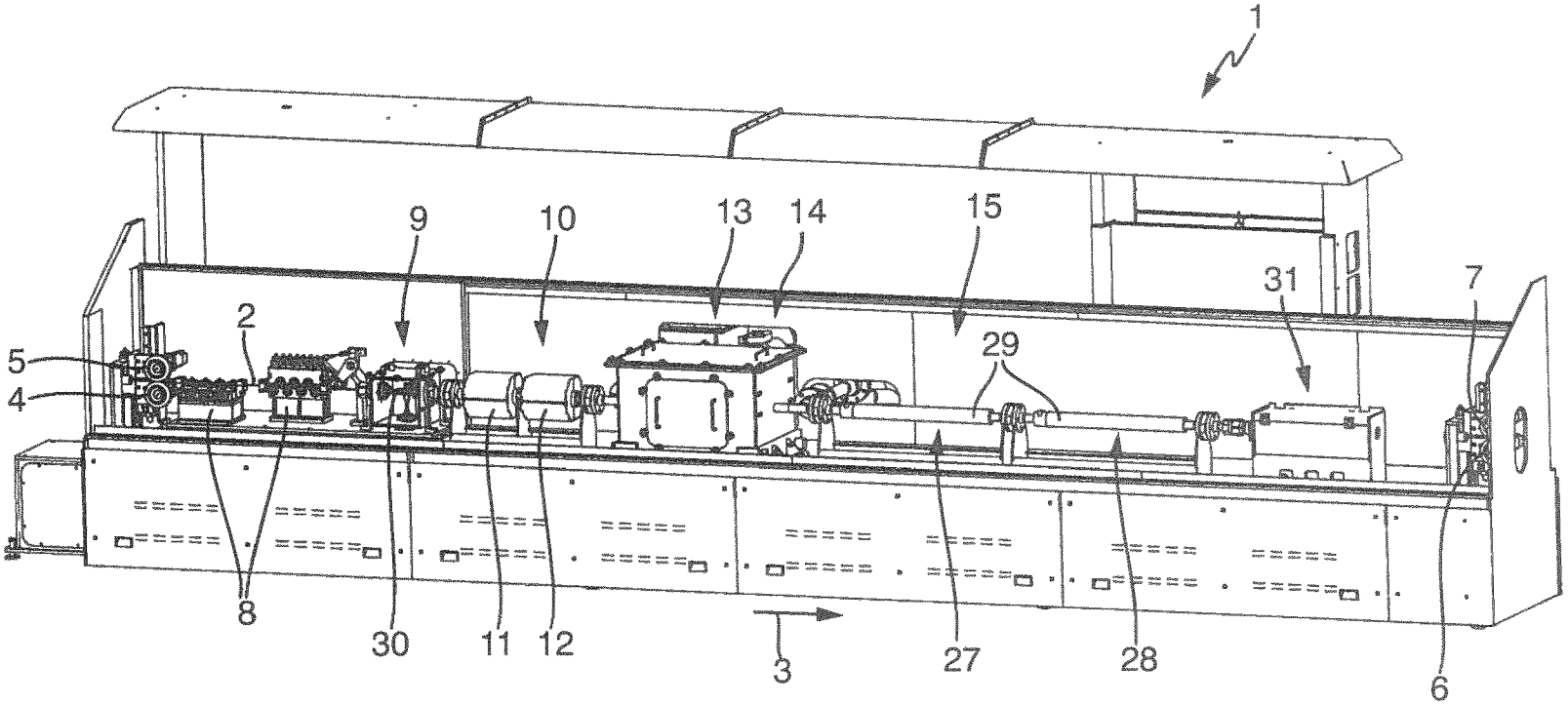
FIG. 1 shows a schematic perspective view of an annealing furnace according to an embodiment of the invention.

In FIG. 1, an annealing furnace 1 is shown schematically in an embodiment of the present invention. In the annealing furnace 1 a stainless steel tube 2 is annealed as a strand within the meaning of the present application at a temperature of 400° C. To anneal the steel tube, the steel tube 2 is guided in the direction of transport (this is denoted in FIG. 1 by arrow 3) through the annealing furnace 1. Thus, the annealing of tube 2 takes place continuously in furnace 1.

According to the present application, there are two pairs of motor-driven drive rollers 4, 5 and 6, 7 acting as a transport device for transporting tube 2 through the annealing furnace 1. These drive rollers are engaged with the stainless steel tube 2 to be annealed, so that a rotation of the rollers 4, 5, 6, 7 leads to a translational movement of tube 2 in the direction of transport 3 through the annealing furnace 1.

A pair of sets of straightening rollers 8 are also provided in the inlet region of the annealing furnace 1, which help to straighten the cold-deformed, incoming tube in the X- and Y-direction in the annealing furnace 1, so that it is substantially straight before it is annealed in the furnace.

The presented embodiment of the annealing furnace 1 comprises two heating apparatuses 9, 10. According to the present application, the heating apparatus 9 is a first heating apparatus and the heating apparatus 10 is a second heating apparatus. The second heating apparatus 10 comprises two heating radiators 11, 12.

The first heating apparatus 9 in the direction of transport 3 of the annealing furnace 1 is an induction heating apparatus, in which the steel tube 2 is heated using a current induced by an induction coil in the tube 2 to be heated.

Such an induction heating has the advantage of quickly heating the tube 2 in a very efficient way, but causes only a very small length expansion of the tube 2.

The induction coil 30 surrounds tube 2 in a concentric manner, wherein the coil is wound on a hollow glass cylinder which extends between the turns of the coil and tube 2.

In the case of radiators 11, 12, the second heating apparatuses, which are disposed in the direction of transport 3 of the tube 2 behind the first inductive heating apparatus 9, are conventional electrically operated resistance heaters. The inside of radiators 11, 12 is heated with the help of heating coils so that tube 2 does not cool or hardly cools on its way from the first inductive heating apparatus 9 to the cooling devices.

The annealing furnace 1 in the embodiment shown in FIG. 1 has a total of four different cooling devices 13, 14, 15, 31.

The core element for cooling the annealed tube 2 in the direction of transport 3 behind the second radiator 12 is a quenching or sudden cooling consisting of two cooling devices 13, 14, which are integrated with each other. According to the present application both these cooling devices 13, 14 are the first and second cooling devices.

The first cooling device 13 is a gas flow cooling for cooling the outer surface, that is, the envelope surface of the tube 2. It uses a gas flow of hydrogen for cooling, which flows past the outer surface of tube 2 and thus cools the tube.

However, in the second cooling device 14, there is a contact cooling, which provides thermal contact between the tube and a water cooling for heat dissipation in the annealed tube 2.

Figure 2:
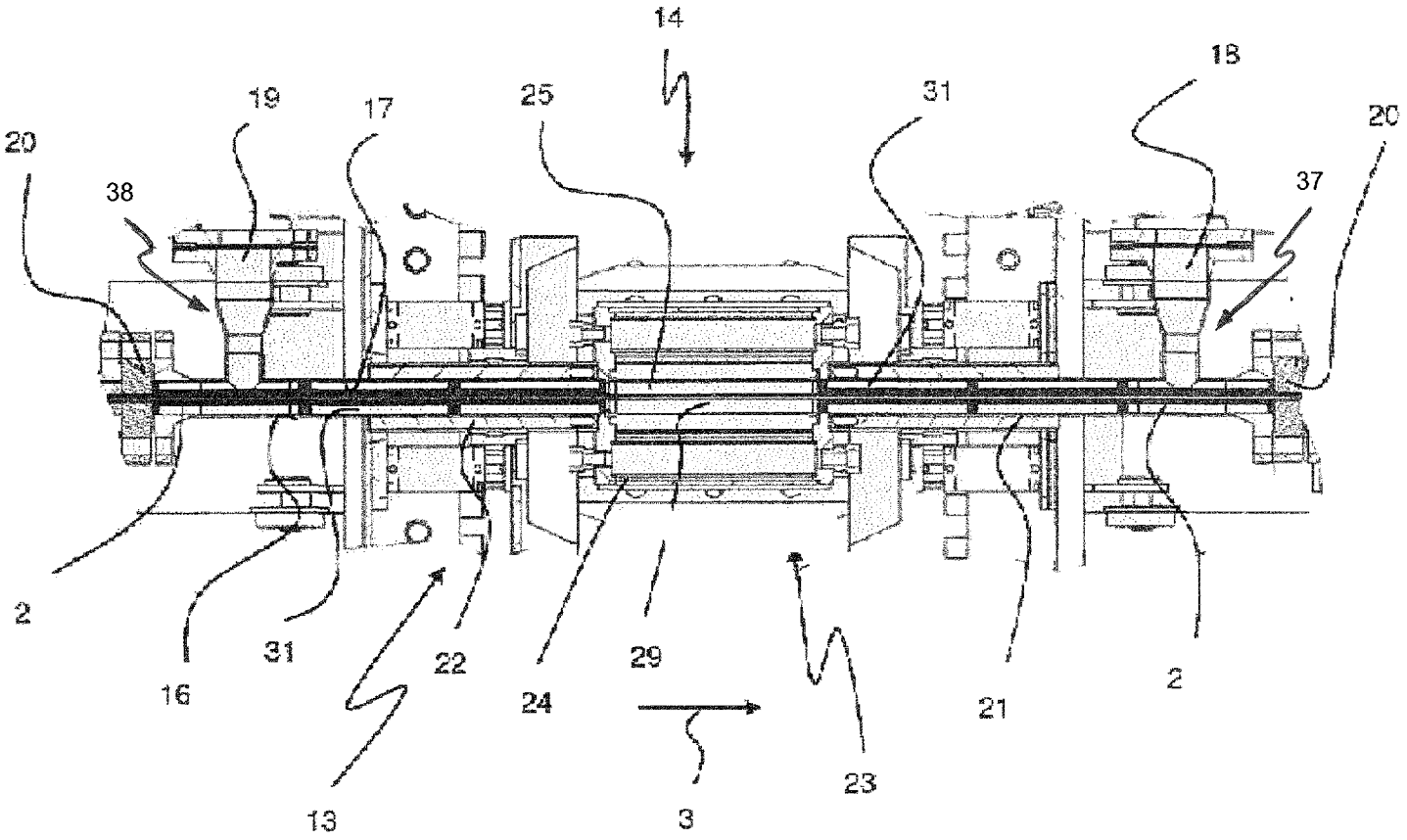
FIG. 2 shows a broken sectional view through two of the cooling devices of the annealing furnace from FIG. 1.

The broken sectional view of FIG. 2 shows the two cooling devices 13, 14 in detail. The gas flow cooling of the first cooling device 13 mainly consists of a housing 16 concentrically surrounding tube 2 to be cooled as gas guide within the meaning of the present application. This gas guide ensures that the cooling gas is conducted past the outer surface 17 of tube 2 to be cooled.

The housing 16 surrounding tube 2 to be cooled as a gas guide comprises a gas inlet 18 for supplying the cooling gas and a gas outlet 19 for discharging the gas. The gas inlet 18 is connected to a gas reservoir for hydrogen ($H_2$) during the operation of the annealing furnace.

The housing 16 of the gas guide has one gas restrictor 20 at its front and one gas restrictor at its rear end to ensure that as little gas as possible can escape from the gas guide. In the region of the restrictor 20, the distance of the housing 16 to tube 2 to be cooled is significantly less than the distance between the inner walls of both the tube portions 21, 22 of the housing 16 and tube 2 to be cooled. The resulting radial clearance between the restrictor 20 and tube 2 to be cooled therefore has a substantially higher flow resistance for the cooling gas than the tube sections 21, 22 of the housing 16 and the housing flanges 37, 38 so that the gas escapes primarily through gas outlet 19 from the cooling device. In one embodiment the restrictors 20 are made of graphite in order to avoid damage to tube 2 in case of an engagement between restrictors 20 and the stainless steel tube 2 to be cooled.

The gas inlet 18 of the first cooling device 13 is, in the direction of transport 3 of tube 2 to be annealed, behind the gas outlet 19. This facilitates the flow of cooling gas, in operation of the furnace, counter to the direction of transport 3 on the outer surface 17 of tube 2.

The housing 16 of the gas guide of the first cooling device 13 is not a continuous tube, but consists of three segments (21, 22, 23). The first segment 21 is a tube section 21 concentrically surrounding tube 2 to be cooled, which is connected to flange 37 as gas inlet 18. A second section 22 is also configured as a tube section concentrically surrounding tube 2 to be cooled. The latter is in turn connected to a flange 38 as a gas outlet 19.

The tubes 21, 22 of housing 16 are lined from inside with a liner 31 made of graphite. This prevents damage to the tube 2 to be cooled in case it is engaged with the housing 16.

Between the two tubular segments or sections 21, 22 of the gas guide there is another section 23 of the gas guide, in which the second cooling device 14 is extended. In this section 23, the gas guide is provided with a substantially cylindrical body 24 which has a much larger inner diameter as compared to both the tube portions 21, 22 of the housing 16. This body 24 is sealed with tubes 21, 22 connected to the other two sections of the gas guide. The gas flows through the designated channels within the body 24 which channels extend up to tube 2 to be cooled or up to its outer surface 17.

The contact cooling of the second cooling device 14 is also arranged within the body 24. The cooling effect of this contact cooling is based on the four cheeks 25 made of graphite that engage with tube 2 to be cooled inside the body 24 and thus a thermal contact between tube 2 and the graphite cheeks 25 is established, which is used for removing the heat from the tube. The design of the contact elements 25 made of graphite has the advantage that they have a comparatively high thermal conductivity and at the same time demonstrate a low sliding friction between tube 2 and cheeks 25. The graphite cheeks 25 must be hydraulically pressed using a combination of hydraulic cylinders and pistons against the tube 2 in order to achieve a good thermal contact between the graphite cheeks 25 and the tube 2.

Figure 3:
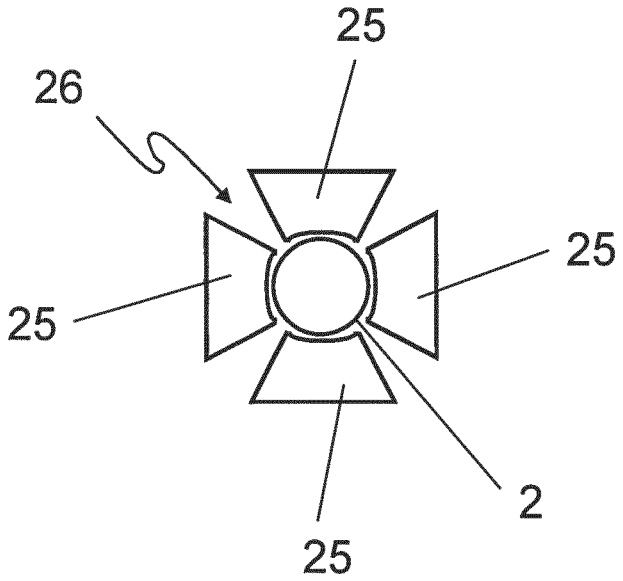
FIG. 3 shows a schematic cross-sectional view through one of the cooling devices of the annealing furnace from FIG. 2.

The cheeks 25 are subject to wear by friction against the tube 2. However, this wear is automatically compensated by the hydraulic pressing against the cheeks 25. To facilitate this compensation, the cheeks 25 are designed conically in cross section, wherein the four cheeks together do not cover a full 360° ring, but a clearance is provided in each case between the cheeks 25. There is a schematic cross sectional view through cheeks 25 and tube 2, in which the formed clearances 26 can be clearly identified as shown in FIG. 3. This clearance is not only a possibility of compensating the wear of the cheeks, but also indicates that the cooling gas can at least flow past in sections along tube 2.

Coming back to the presentation in FIG. 1, the structure of the downstream cooling devices 15 and 31 will now be described in detail. These cooling devices 15, 31 form a third cooling device 15 and a fourth cooling device 31 used for cooling the outer surface 17 of the tube 2 according to the claims of the present application.

The cooling device 15 comprises two cooling registers 27, 28, which are formed by water-cooled tube sections 29, wherein the heat transfer takes place between tube 2 to be cooled and the cooled tube sections 29 through heat radiation and convection.

Tube 2 is finally directly sprayed with cooling liquid, here water, in the last cooling device 31 in the direction of transport 3, a so-called water tank, which drips and is scraped with a scraper from the tube before the outlet of the tube from the water tank.

The annealing furnace in FIG. 1 additionally comprises a flushing device used for flushing the inner surface of the annealed tube 2. For this, a gas outlet (not shown) of a reservoir is connected in a sealing manner to the beginning of the tube 2 to be annealed in the direction of transport 3 of the tube 2 in front of the annealing furnace 1 so that the gas can flow into the tube and flow through it.

Figure 4:
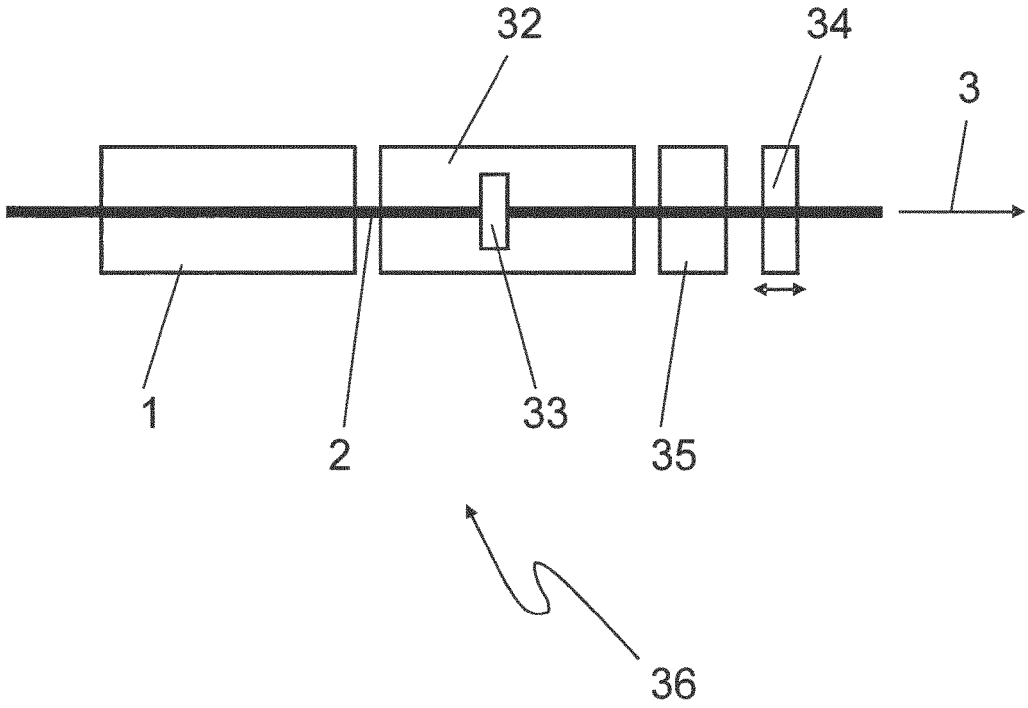
FIG. 4 shows a schematic view of a deforming system according to an embodiment of the present invention.

An embodiment of the invention schematically shown in FIG. 4 demonstrates a continuously working drawing bench 32 for cold deforming the tube 2 after the annealing furnace 1. During the cold deforming of the tube 2, the outside diameter of tube 2 is reduced by moving tube 2 through a drawing die 33. A flying saw 34, which is moved with the tube 2 in the direction of transport 3 of tube 2, is also provided behind the drawing bench 32, so that tube 2 can be cut into tube sections of a defined length during the drawing of the tube. In addition, a $CO_2$-cleaning device 35 is provided between the drawing bench 32 and the flying saw 34 for cleaning the outer surface of the tube 2. The remaining lubricant can be removed from the outer surface of the tube 2 with the help of this cleaning device 35. The arrangement of annealing furnace 1, draw bench 32, cleaning device 35 and flying saw 34 is designated in the sense of the present application as deforming system 36.

For purposes of the original application it should be noted that all features as they become apparent from the following description, the drawings and the claims for a person skilled in the art, even if they were described concretely only in connection with certain other features, can be combined both individually and in any combinations with other features disclosed herein or group of features, unless this has been expressly excluded or if technical factors make such combinations impossible or pointless. A comprehensive, explicit presentation of all conceivable combinations of features described here is omitted only for the sake of brevity and readability of the description. Although the invention was presented and described in detail in the drawings and the foregoing description, this presentation and description are merely exemplary and are not a limitation of the scope as defined by the claims. The invention is not limited to the disclosed embodiments.

Modifications to the disclosed embodiments will be apparent to a person skilled in the art from the drawings, the specification and the appended claims. In the claims, the word "comprising" does not exclude other elements or steps, and the indefinite article "a" or "an" does not exclude a plurality. The mere fact that certain features are claimed in different claims does not exclude their combination. Reference numerals in the claims should not be construed as limiting the scope.

REFERENCE LIST

1 Annealing furnace
2 Stainless steel tube
3 Direction of transport
4, 5, 6, 7 Driver rollers
8 Straightening roller assembly
9 First heating apparatus
10 Second heating apparatus
11, 12 Radiators of the second heating apparatus
13, 14, 15, 31 Cooling device
16 Housing sections of the gas guide
17 Outer surface of the stainless steel tube 2
18 Gas inlet
19 Gas outlet
20 Seal
21, 22, 23 Gas guide housing
24 Cylindrical body
25 Graphite cheek
26 Clearance
27, 28 Cooling register
29 Water-cooled tube sections
30 Induction coil
31 Graphite liner
32 Drawing bench
33 Drawing die
34 Flying saw
35 CO2 cleaning device
36 Deforming system
37, 38 Flange

The invention claimed is:

1. An annealing furnace for annealing a strand of steel with a first heating apparatus for heating the strand during operation of the annealing furnace, a transport device for the strand arranged to advance the strand in a direction of transport through the annealing furnace during operation of the annealing furnace, the annealing furnace, in the direction of transport, following the first heating apparatus, comprising:

a first cooling device for cooling the outer surface of the strand by gas flow cooling, the first cooling device including a gas guide, wherein the first cooling device is arranged to cool the strand during the operation of the annealing furnace as a gas flows over the outer surface of the strand, and a second cooling device for cooling the outer surface of the strand by contact cooling, wherein the second cooling device cools the strand during the operation of the annealing furnace by thermal contact between the strand and a liquid cooled contact element, wherein the first cooling device includes a first section and a second section, and wherein, relative to the direction of transport, the first section of the first cooling device is arranged before the second cooling device and the second section of the first cooling device is arranged after the second cooling device.

2. The annealing furnace according to claim 1, wherein the gas guide includes a housing surrounding the strand during operation of the annealing furnace, the housing being arranged concentrically to the strand, the housing having a gas inlet and a gas outlet for the gas.

3. The annealing furnace according to claim 2, wherein the housing of the gas guide includes a seal both at a front end and a rear end for sealing the housing against the strand during operation of the annealing furnace.

4. The annealing furnace according to claim 2, wherein the gas inlet of the gas guide is in fluid communication with a reservoir for the gas, wherein the reservoir during the operation of the annealing furnace contains hydrogen so that the outer surface of the strand can be cooled with the gas.

5. The annealing furnace according to claim 2, wherein the gas outlet is arranged before the gas inlet in the direction of transport of the strand so that the gas flows counter to the direction of transport past the strand during operation of the annealing furnace.

6. The annealing furnace according to claim 1, wherein the second cooling device includes a pneumatic or hydraulic device which is constructed and arranged in such a manner that it keeps the liquid cooled contact element in engagement with the strand during operation of the annealing furnace.

7. The annealing furnace according to claim 1, wherein the contact element is made of graphite.

8. The annealing furnace according to claim 1, wherein the second cooling device includes a fluid cooling system arranged to dissipate the heat transferred from the strand to the liquid cooled contact element during operation of the annealing furnace.

9. The annealing furnace according to claim 1, wherein the liquid cooled contact element of the second cooling device is arranged within the first cooling device for cooling the outer surface of the strand.

10. The annealing furnace according to claim 1, further comprising a third cooling device for cooling the outer surface of the strand, the third cooling device having a housing with a fluid cooling system, which surrounds the strand during operation of the annealing furnace.

11. The annealing furnace according to claim 9, wherein the liquid cooled contact element of the second cooling device is arranged within the housing of the gas guide.

12. The annealing furnace according to claim 2, wherein the gas inlet is located in the second section of the first cooling device and the gas outlet is located in the first section of the first cooling device.

13. The annealing furnace according to claim 1, wherein the gas guide extends continuously from a first end associated with the first section of the first cooling device to a second end associated with the second section of the first cooling device.

14. The annealing furnace according to claim 1, wherein the gas guide is incorporated into the second cooling device, and wherein, in the second cooling device, an inner diameter of the gas guide is larger than an inner diameter of the gas guide in the first cooling device.

15. The annealing furnace according to claim 14, wherein, in the second cooling device, the gas guide includes a plurality of flow channels.

16. The annealing furnace according to claim 15, wherein the plurality of flow channels extend up to an outer surface of the strand of steel.

17. The annealing furnace according to claim 15, wherein the plurality of flow channels connect the gas guide in the first section of the first cooling device with the gas guide in the second section of the first cooling device.

18. The annealing furnace according to claim 1, wherein the second cooling device for cooling the outer surface of the strand includes:

a contact element in slideable contact with the strand during operation of the annealing furnace so that thermal contact is established between the strand and the liquid cooled contact element, and a pneumatic or hydraulic device that maintains the slideable contact between the liquid cooled contact element and strand during operation of the annealing furnace.

19. The annealing furnace according to claim 18, wherein the liquid cooled contact element has a conical cross section.

20. The annealing furnace according to claim 18, wherein the liquid cooled contact element is made of graphite.

21. The annealing furnace according to claim 18, wherein the second cooling device includes a fluid cooling system arranged to dissipate the heat transferred from the strand to the liquid cooled contact element during operation of the annealing furnace.

* * * * *